US005105464A

United States Patent [19]

Zinser

[11] Patent Number: 5,105,464

[45] Date of Patent: Apr. 14, 1992

[54] MEANS FOR IMPROVING THE SPEECH QUALITY IN MULTI-PULSE EXCITED LINEAR PREDICTIVE CODING

[75] Inventor: Richard L. Zinser, Schenectady, N.Y.

[73] Assignee: General Electric Company, Schenectady, N.Y.

[21] Appl. No.: 353,856

[22] Filed: May 18, 1989

[51] Int. Cl.[5] ..... G10L 9/14

[52] U.S. Cl. ..... 381/38

[58] Field of Search ..... 381/36–49; 364/513.5

[56] References Cited

U.S. PATENT DOCUMENTS

| | | | |
|---|---|---|---|
| 4,184,049 | 1/1980 | Crochiere et al. | 381/41 |
| 4,457,013 | 6/1984 | Castellino et al. | 381/46 |
| 4,688,224 | 8/1987 | Dal Degan et al. | 371/31 |
| 4,720,865 | 1/1988 | Taguchi | 381/49 |
| 4,776,014 | 10/1988 | Zinser, Jr. | 381/38 |
| 4,873,723 | 10/1989 | Shibagaki et al. | 381/36 |
| 4,890,328 | 12/1989 | Prezas et al. | 381/38 |
| 4,924,508 | 5/1990 | Crepy et al. | 381/38 |
| 4,945,565 | 7/1990 | Ozawa et al. | 381/38 |
| 4,962,536 | 10/1990 | Satoh | 381/49 |

OTHER PUBLICATIONS

Kroon et al., "Strategies for Improving the Performance of CELP Coders at Low Bit Rates", *Proc. of 1988 IEEE Int. Conf. on Acoustics, Speech and Signal Processing*, Apr. 1988, pp. 151–154.

Schroeder et al., "Code Excited Linear Prediction (CELP): High Quality Speech at Very Low Bit Rates", *Proc. of 1985 IEEE Int. Conf. on Acoustics, Speech and Signal Processing*, Mar. 1985, pp. 937–940.

Sreenivas, "Modelling LPC Residue by Components for Good Quality Speech Coding," *Proc. of 1988 IEEE Int. Conf. on Acoustics, Speech and Signal Processing*, Apr. 1988, pp. 171–174.

Dal Degan et al., "Communications by Vocoder on A Mobile Satellite Fading Channel", *Proc. of IEEE Int. Conf. on Communications*, Jun. 1985, pp. 771–775.

Areseki et al., "Multi-Pulse Excited Speech Coder Based on Maximum Crosscorrelation Search Algorithm", *Proc. of IEEE Globecom 83*, Nov. 1983, pp. 794–798.

Singhal et al., "Amplitude Optimization and Pitch Prediction in Multipulse Coders", *IEEE Trans. on Acoustics, Speech and Signal Processing*, 37, Mar. 1989, pp. 317–327.

Atal et al., "A New Model of LPC Excitation for Producing Natural Sounding Speech at Low Bit Rates", *Proc. of 1982 IEEE Int. Conf. on Acoustics, Speech and Signal Processing*, May 1982, pp. 614–617.

*Primary Examiner*—Dale M. Shaw
*Assistant Examiner*—Michelle Doerrler
*Attorney, Agent, or Firm*—Lawrence P. Zale; James C. Davis, Jr.; Marvin Snyder

[57] ABSTRACT

A technique that reconciles the differences between the estimator and the filter of a multi-pulse linear predictive voice encoder achieves a higher quality in the output speech. The technique simultaneously solves for the pulse amplitudes and pitch tap gain to minimize the estimator bias in the multi-pulse excitation and thereby improves, performance of the system. The increased signal-to-noise ratio is accomplished by first modifying the pitch predictor such that the pitch synthesis filter accurately reflects the estimation procedure used to find the pitch tap gain and, second, improving the excitation analysis technique such that the pitch predictor tap gain and pulse amplitudes are solved for simultaneously, rather than sequentially. Neither of these modifications results in an increased transmission rate and they do not significantly increase the complexity of the multi-pulse coding algorithm.

4 Claims, 4 Drawing Sheets

MEANS FOR IMPROVING THE SPEECH QUALITY IN MULTI-PULSE EXCITED LINEAR PREDICTIVE CODING

DESCRIPTION

CROSS-REFERENCE TO RELATED APPLICATION

This application is related in subject matter to Richard L. Zinser application Ser. No. 07/353,855, filed May 18, 1989 concurrently herewith for "Hybrid Switched Multi-Pulse/Stochastic Speech Coding Technique" and assigned to the instant assignee. The disclosure of that application is incorporated herein by reference.

BACKGROUND OF THE INVENTION

1. Field of the Invention

The present invention generally relates to digital voice transmission systems and, more particularly, to a new technique for increasing the signal-to-noise ratio (SNR) in a linear predictive multi-pulse excited speech coder.

2. Description of the Prior Art

Code excited linear prediction (CELP) and multi-pulse linear predictive coding (MPLPC) are two of the most promising techniques for low rate speech coding. While CELP holds the most promise for high quality, its computational requirements can be too great for some systems. MPLPC can be implemented with much less complexity, but it is generally considered to provide lower quality than CELP.

Multi-pulse coding is believed to have been first described by B. S. Atal and J. R. Remde in "A New Model of LPC Excitation for Producing Natural Sounding Speech at Low Bit Rates", *Proc. of* 1982 *IEEE Int. Conf. on Acoustics, Speech, and Signal Processing*, May 1982, pp. 614–617. It was described to improve on the rather synthetic quality of the speech produced by the standard U.S. Department of Defense LPC-10 vocoder. The basic method is to employ the linear predictive coding (LPC) speech synthesis filter of the standard vocoder, but to use multiple pulses per pitch period for exciting the filter, instead of the single pulse used in the Department of Defense standard system. The basic multi-pulse technique is illustrated in FIG. 1.

Absent in the Atal et al. paper is the all-important solution technique for the optimal locations and amplitudes of the pulses used to excite the synthesis filter. Since the publication of the Atal et al. paper, a large effort has been expended in devising a low-complexity solution for the amplitudes and positions. A truly optimal technique requires simultaneous solution for the pulse amplitudes and positions; however, this would result in a non-linear set of equations whose solution would be quite difficult. Most of the published techniques find the pulse positions sequentially, and then as each new position is found, they solve simultaneously for a new set of amplitudes for the new pulse and all previous pulses. The solution for the amplitudes is a simple set of linear equations that is easily solved simultaneously. This method is nearly optimal and gives excellent results. The technique is described in more detail by T. Araseki et al. in "Multi-pulse Excited Speech Coder Based on Maximum Crosscorrelation Search Algorithm", *Proc. of IEEE GLOBECOM* 83, Nov. 1983, pp 794–798.

To achieve low transmission rates, a multi-pulse coder must be used with longer frame lengths than those optimal for good voice quality. In addition, a pitch predictor is usually added, since it provides a large increase in quality for a small increase in rate. For proper operation, the pitch predictor gain and delay lag must be computed from the cross-correlation between the data in the pitch synthesis filter buffer (i.e., output data from the previous frame) and the present frame of input data to be coded. The term "frame" is used herein to refer to a contiguous time sequence of analog-to-digital samplings of a speech waveform. When a pitch predictor of this type is used in a coding system with frame lengths longer than the minimum expected pitch period, it is no longer possible to estimate the pitch lag and gain optimally because the data required for the estimation process is not yet available. In other words, the dilemma is that the output signal of the pitch synthesis filter is required to estimate the filter parameters, but no output signal can be generated before the parameters are known.

When a pitch predictor is integrated into a multi-pulse coder, there could be significant cross-correlation between the excitation provided by the predictor and the excitation provided by the pulses. In a conventional implementation, however, the predictor and pulse information are solved for sequentially and independently, precluding use of any knowledge of cross-correlation. Yet, if the cross-correlation is not taken into account, the estimation of the pulse amplitudes and predictor gain will be biased, resulting in decreased performance.

As stated above, a pitch predictor is frequently added to the multi-pulse coder to further improve the SNR and speech quality. The pitch predictor comprises a recursive infinite impulse response (IIR) digital filter with a single tap placed at a lag equal to the number of samples in the pitch period:

$$y(i)=\beta y(i-P)+e(i), \tag{1}$$

where e(i) is the pulse excitation sequence, y(i) is the pitch predictor output sequence, $\beta$ is the pitch predictor tap gain, and P is the pitch lag. To solve for $\beta$ and P, the lag (P) is first estimated by the location of the peak cross-correlation between the filtered samples in the pitch buffer and the input sequence. The gain ($\beta$) is then given by the normalized cross-correlation $$\beta = \frac{\sum_{i=0}^{N-1} y_p(i-P)x'(i)}{\sum_{i=0}^{N-1} y_p^2(i-P)} \tag{2}$$

here x'(i) is the weighted input sequence, yp(i) contains the filtered pitch buffer samples (i.e., the previous output sequence from Equation (1)), and N is the frame length. By examining Equations (1) and (2), the cause of the previously-mentioned dilemma becomes apparent; that is, if the pitch lag P is shorter than the frame length N, the sums in Equation (2) require filtered values yp(i−P) generated from the pitch buffer that have not yet been synthesized (i.e., when i−P is equal to or greater than 0). A preferred method for finding $\beta$ is to simply extend the pitch buffer by copying previous values at a distance of P samples:

$$\beta = \frac{\sum_{i=0}^{P-1} y_p(i-P)x'(i) + \sum_{i=P}^{N-1} y_p(i-2P)x'(i)}{\sum_{i=0}^{P-1} y_p^2(i-P) + \sum_{i=P}^{N-1} y_p^2(i-2P)}, \quad (3)$$

for $P < N < 2P$

Equation (3) assumes that 2P is greater than N. It is a simple matter to extend the pitch buffer for shorter pitch lags/longer frame lengths.

The value for given in Equation (3) is only an approximation if the standard pitch synthesis filter of Equation (1) is used. The estimated value for $\beta$ will be correct only if the sequence being synthesized is perfectly periodic; i.e., $\beta = 1.0$. While this method has been used with reasonable success in systems where the frame length is relatively short (i.e., when P is usually greater than N, but only occasionally less than N), it will perform very poorly when N is increased such that the value taken on by P is frequently less than N. Another problem with using Equation (3) to estimate values for Equation (1) lies in the fact that these two equations are incompatible since the system will not perform properly when used with a simultaneous solution.

In any given speech coding algorithm, it is desirable to attain the maximum possible SNR in order to achieve the best speech quality. In general, to increase the SNR for a given algorithm, additional information must be transmitted to the receiver, resulting in a higher transmission rate. Thus, a simple modification to an existing algorithm that increases the SNR without increasing the transmission rate is a highly desirable result.

SUMMARY OF THE INVENTION

It is therefore an object of the present invention to provide a technique for speech coding that reconciles the differences between the estimator of Equation (3) and the filter of Equation (1) and thereby achieves a higher quality in the output speech.

It is another object of the invention to provide a technique for speech coding that will simultaneously solve for the pulse amplitudes and pitch tap gain to minimize the estimator bias in the multi-pulse excitation and thereby improve performance of the system.

According to the invention, increased SNR in a multi-pulse excited linear predictive speech coder which includes a pitch predictor and a pitch synthesis filter is accomplished by first modifying the pitch predictor such that the pitch synthesis filter accurately reflects the estimation procedure used to find the pitch tap gain and, second, improving the excitation analysis technique such that the pitch predictor tap gain and pulse amplitudes are solved for simultaneously, rather than sequentially. Neither of these modifications results in an increased transmission rate or a significant increase in complexity of the multi-pulse coding algorithm.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF A PREFERRED EMBODIMENT OF THE INVENTION

Figure 1:
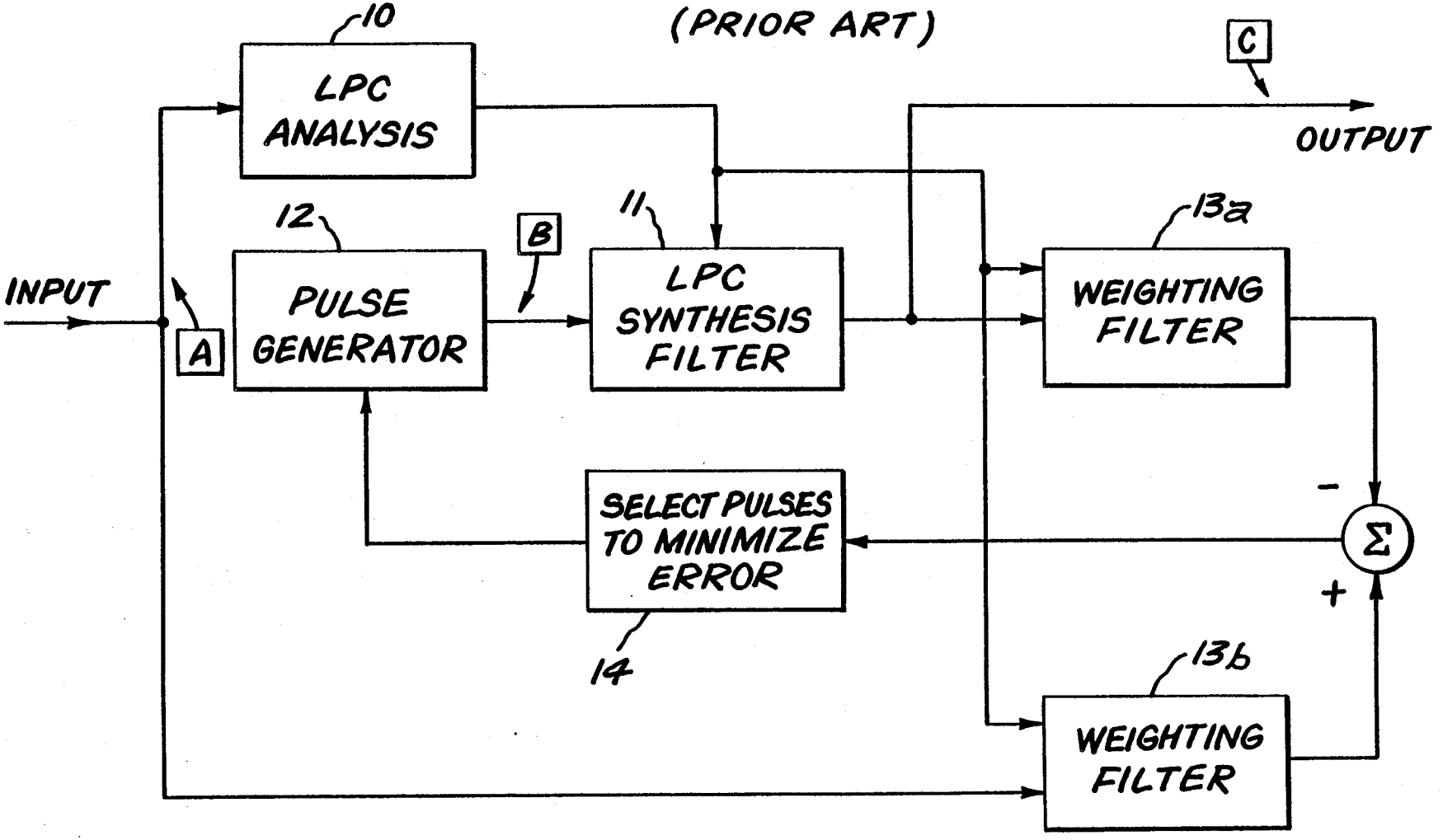
FIG. 1 (PRIOR ART)
FIG. 1 is a block diagram showing the implementation of the basic multi-pulse technique for exciting the speech synthesis filter of a standard voice coder.
Figure 2:
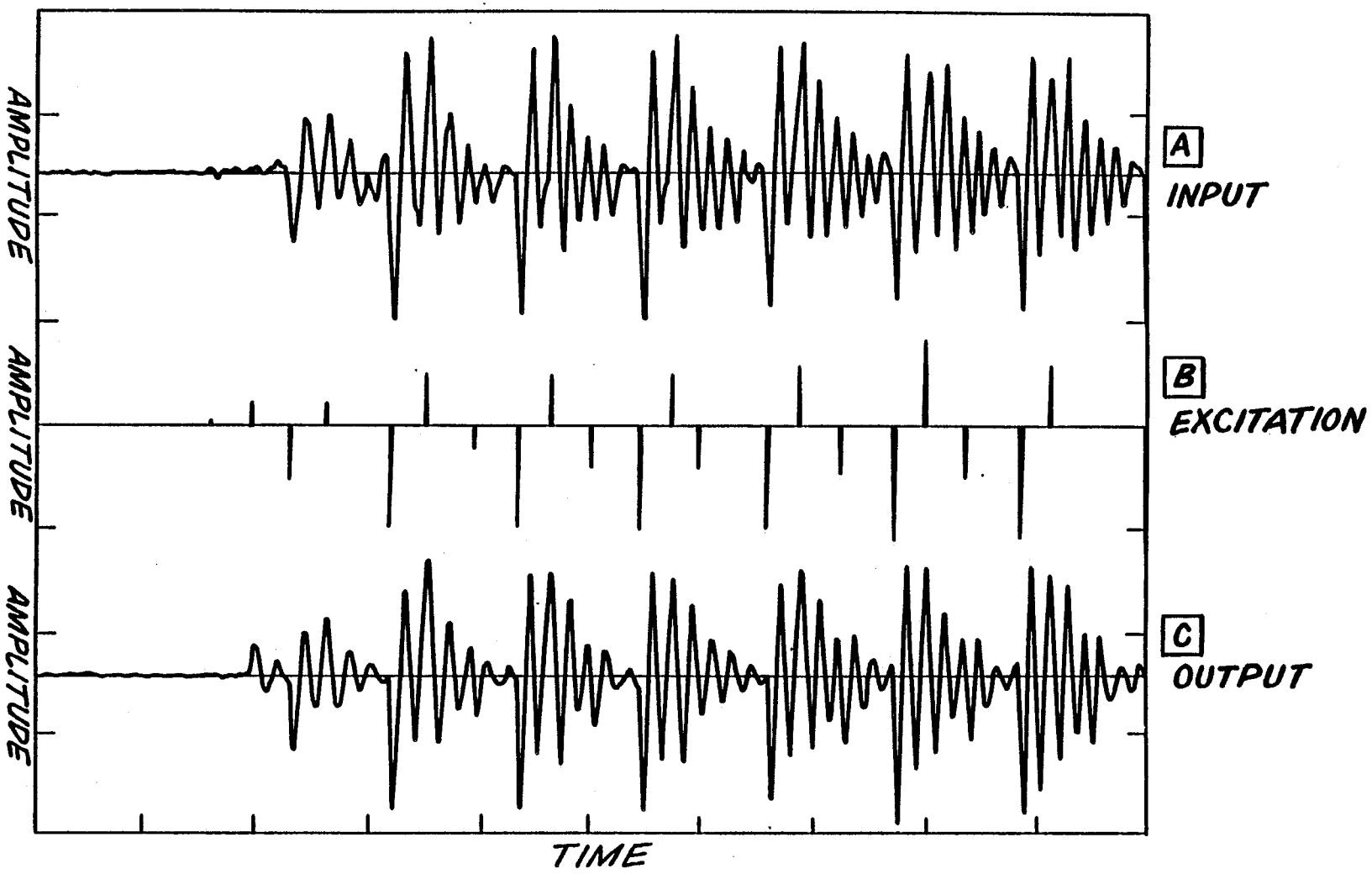
FIG. 2 (PRIOR ART)
FIG. 2 is a graph showing respectively the input signal, the excitation signal and the output signal in the system shown in FIG. 1.

In employing the basic multi-pulse technique, as shown in FIG. 1, the input signal at A (shown in FIG. 2) is first analyzed in a linear predictive coding (LPC) analysis circuit 10 to produce a set of linear prediction filter coefficients. These coefficients, when used in an all-pole LPC synthesis filter 11, produce a filter transfer function that closely resembles the gross spectral shape of the input signal. A feedback loop formed by a pulse generator 12, synthesis filter 11, weighting filters 13*a* and 13*b*, and an error minimizer 14 generates a pulse excitation at point B that, when fed into filter 11, produces an output waveform at point C that closely resembles the input waveform at point A. This is accomplished by selecting the pulse positions and amplitudes to minimize the perceptually weighted difference between the candidate output sequence and the input sequence. Trace B in FIG. 2 depicts the pulse excitation for filter 11, and trace C shows the output signal of the system. The resemblance of signals at input A and output C should be noted. Perceptual weighting is provided by the weighting filters 13*a* and 13*b*. The transfer function of these filters is derived from the LPC filter coefficients. A more complete understanding of the basic multi-pulse technique can be gained from the aforementioned Atal et al. paper.

To solve the incompatibility problem between the estimator, as represented by Equation (3), and the pitch predictor synthesis filter, as represented by Equation (1), the pitch synthesis filter is modified as follows:

$$y'(i) = \begin{cases} \beta y(i-P) + e(i), & i < P \\ \beta y(i-2P) + e(i), & P < i < 2P \\ \beta y(i-3P) + e(i), & 2P \leqq i < 3P \\ \text{etc.} \end{cases} \quad (4)$$

Use of Equation (4) with the results of Equation (3) removes any error or estimator bias in the tap gain $\beta$, since the data used in calculating ( corresponds exactly to the data used to generate the output sequence y(i). Furthermore, the system is causal, with all coefficients being estimated from the previous frame's data.

The above pitch prediction technique may be used to develop the equations for simultaneous solution of the pulse amplitudes and pitch tap gain. The error to be minimized is given by $$E^2 = \sum_{i=0}^{N-1} [x(i) - g_1h(i-m_1) - g_2h(i-m_2) - \ldots - g_Mh(i-m_M) - \beta y_p(i)]^2, \quad (5)$$

where x(i) is the input sequence, $g_1, \ldots, g_M$ are M pulse amplitudes, h(i) is the LPC synthesis filter impulse response, $m_1, \ldots, m_M$ are the pulse locations, $\beta$ is the pitch tap gain, and $y_P(i)$ is the filtered pitch buffer predictor sequence, as derived from Equation (4). Taking partial derivatives with respect to $g_1, \ldots, g_M$ and $\beta$, setting those equal to zero, and substituting auto- and cross-correlations where appropriate, results in a set of M+1 simultaneous equations to solve:

$$\begin{bmatrix} \sigma_h^2 & R_{hh}(m_1-m_2) & \cdots & R_{hh}(m_1-m_M) & R_{hyp}(m_1) \\ R_{hh}(m_1-m_2) & \sigma_h^2 & \cdots & R_{hh}(m_2-m_M) & R_{hyp}(m_2) \\ \vdots & \vdots & \cdots & \vdots & \vdots \\ R_{hh}(m_M-m_1) & R_{hh}(m_M-m_2) & \cdots & \sigma_h^2 & R_{hyp}(m_M) \\ R_{hyp}(m_1) & R_{hyp}(m_2) & \cdots & R_{hyp}(m_M) & \sigma_{yp}^2 \end{bmatrix} \begin{bmatrix} g_1 \\ g_2 \\ \vdots \\ g_M \\ \beta \end{bmatrix} = \begin{bmatrix} R_{hx}(m_1) \\ R_{hx}(m_2) \\ \vdots \\ R_{hx}(m_M) \\ R_{xyp}(0) \end{bmatrix} \quad (6)$$

where $\sigma_h^2$ is the variance of the synthesis filter impulse response, $R_{hh}(m_j-m_k)$ is the auto-correlation of the impulse response at a lag of $|m_j-m_k|$, $R_{hy}(m_k)$ is the cross-correlation of the impulse response and filtered pitch predictor excitation sequence at position $m_k$, $\sigma_{yp}^2$ is the variance of the filtered pitch predictor sequence, $R_{hx}(m_k)$ is the cross-correlation between the impulse response and the input at position $m_k$, and $R_{xyp}(O)$ is the cross-correlation between the filtered pitch predictor sequence and the input. By solving Equation (6) for $g_1 \ldots, g_M$ and $\beta$, the optimal simultaneous solution for the pulse amplitudes and pitch tap gain is obtained.

Figure 3:
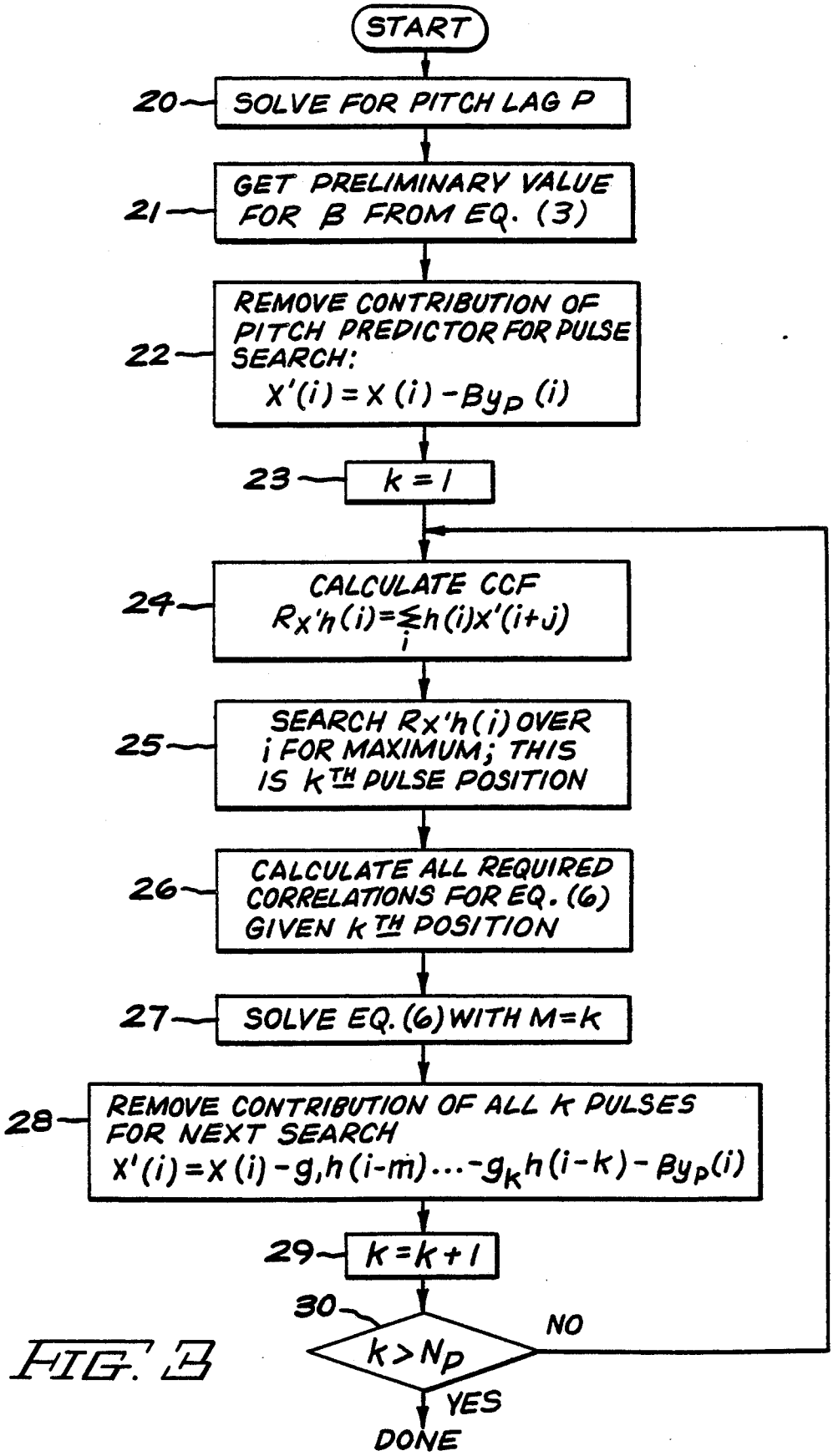
FIG. 3 is a flow diagram showing the logic of the software implementing the technique of the invention for increasing the SNR.

FIG. 3 shows how the aforementioned improvements are implemented in the analysis phase of the multi-pulse coder. Thus FIG. 3 is a flow chart of the iterative pulse solution method (similar to the technique in the aforementioned Araseki et al. paper) with the improved optimization method. Initially, the pitch lag is computed at function block 20, and a preliminary value of $\beta$ is obtained from Equation (3) at function block 21. Before starting the pulse position/amplitude solution iteration, the contribution of the pitch predictor that will be used for subsequent cross-correlation measurement is removed from the input buffer at function block 22. (In the equation of function block 22, x(i) represents the input sequence.) This ensures that the pulse excitation will not duplicate what is already present in the pitch prediction sequence. The process is initialized by setting k=1 at function block 23, and the pulse iteration loop is then entered. During each iteration, a new cross-correlation (CCF) is calculated at function block 24, based on the updated values in the input buffer x'(i). This cross-correlation is searched for a peak at function block 25, with the location of the peak indication being the k-th pulse position. New correlation values are added to Equation (6) at function block 26, and Equation (6) is solved with M=k in function block 27. The contributions of the pulses and pitch prediction are subtracted from the original copy of the input sequence and placed in the x'(i) buffer for subsequent iterations at function block 28. The pulse counter is incremented by one at function block 29, and the pulse counter is tested at decision block 30 to see if all the pulses have been placed yet. If all the pulses have been placed (i.e., $k=N_P$, where $N_P$ is the number of pulses), the process terminates; otherwise, another iteration is performed to place the next pulse and reoptimize all amplitudes and pitch tap gains.

Figure 4:
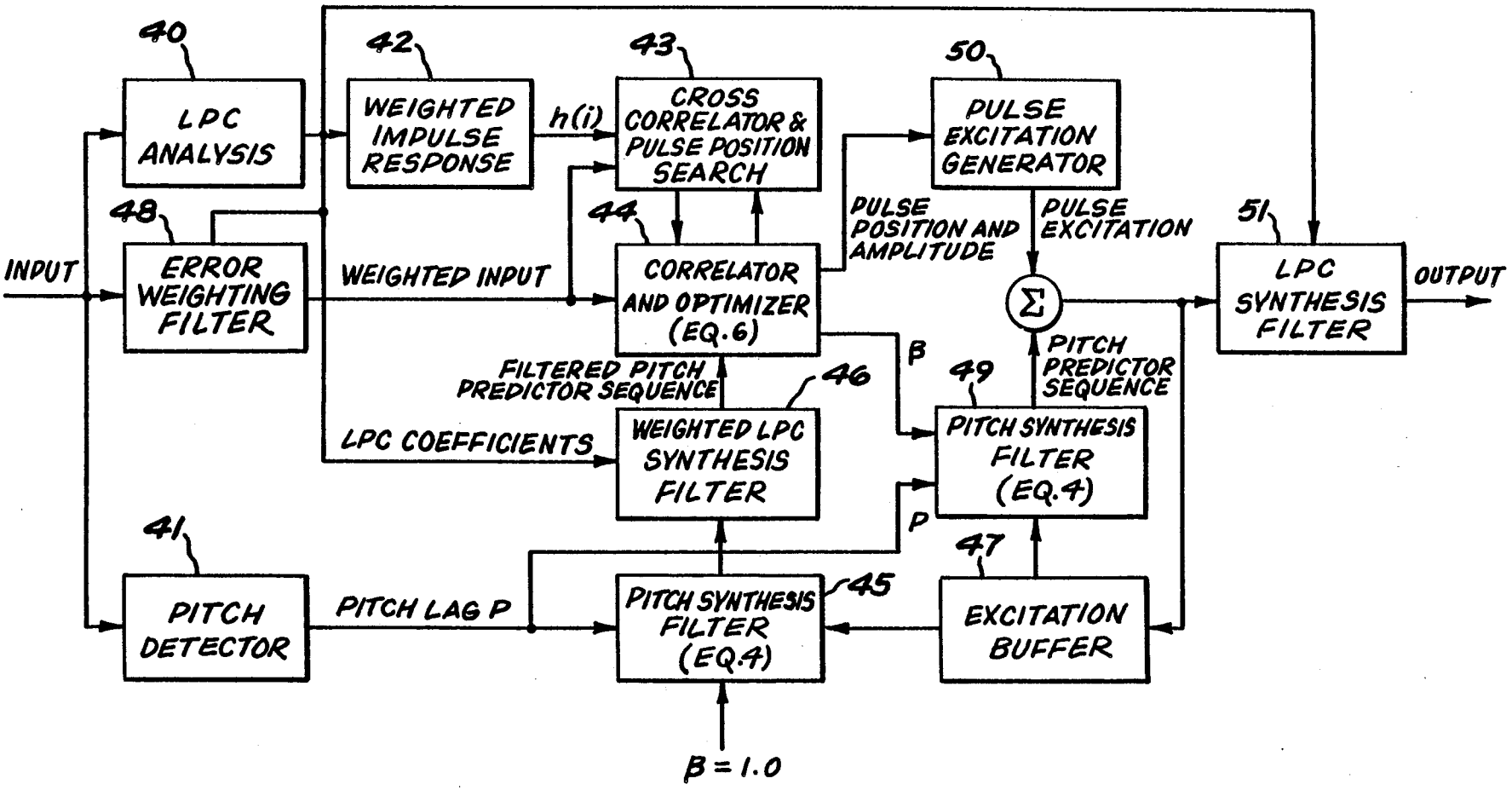
FIG. 4 is a block diagram showing the hardware supporting the implementation of the invention.

FIG. 4 is a block diagram of a multi-pulse coder that utilizes the improvements according to the invention. As in the voice coder of FIG. 1, the input sequence is first passed to an LPC analyzer 40 to produce a set of linear predictive filter coefficients. In addition, the pitch lag P is also calculated directly from the input data by a pitch detector 41. The apparatus of FIG. 4 differs from that of FIG. 1 in that the method for calculating pulse positions and amplitudes is shown more explicitly. To find the pulse information, the impulse response h(i) required in Equation (5) and FIG. 3 is generated in weighted impulse response circuit 42. This response is cross-correlated with the input buffer in a cross-correlator 43. Correlator 43 produces the pulse positions, and an optimizer 44 solves Equation (6) for the optimized amplitudes. Pitch tap gain ($\beta$) is found by filtering in a pitch synthesis filter 45 the old excitation data stored in an excitation buffer 47 according to Equation (4). The data from filter 45 are then run through a perceptually weighted LPC synthesis filter 46 and used by optimizer 44 to simultaneously produce new estimates of $\beta$ and the pulse amplitudes. In filter 45, $\beta$ is set to 1.0 for the purpose of finding the cross-correlations required by Equation (6) and the subsequent solution for the actual value of $\beta$ in optimizer 44. The perceptual error weighting is applied internally in weighted impulse response circuit 42 and in weighted LPC synthesis filter 46 in order to match the weighting applied to the input signal in an error weighting filter 48. The system output signal of the system is produced by exciting an LPC synthesis filter 51 with the sum of the output signals of a pulse excitation generator 50 responsive to optimizer 44, and a pitch synthesis filter 49 which, in turn, filters the output signal of buffer 47 according to Equation (4), utilizing the actual pitch tap gain $\beta$.

A multi-pulse coder having the improvements according to the invention was implemented and compared with a base coder of similar design and identical transmission rate. Table 1 gives the pertinent details for both coders.

TABLE 1

| Analysis Parameters of Tested Coders | |
|---|---|
| Sampling Rate | 8 kHz |
| LPC Frame Size | 256 samples |
| Pitch Frame Size | 64 samples |
| # Pitch Frames/LPC Frame | 4 frames |
| # Pulses/Pitch Frame | 8 pulses |

The baseline coder used the pitch gain estimator of Equation (3), the pitch predictor synthesis filter of Equation (1), and the pulse amplitude reoptimization method of the Araseki et al. coder. The improved coder according to the invention used the pitch gain estimator of Equation (3), the pitch predictor synthesis filter of Equation (4), and the simultaneous pulse amplitude/pitch gain reoptimization algorithm of Equation (6). Both coders were used to code 18.25 seconds of speech, consisting of equal amounts of male and female speech. In making signal-to-noise ratio (SNR) measurements for this segment of speech, four different measures were employed as described below:

SNR-t (Total Segmental SNR): The segmental SNR as measured by $$SNR - t(\text{dB}) = \frac{\sum_{j=0}^{L-1} \left\{ 10 \log_{10} \left[ \frac{\sum_{i=0}^{N-1} x_j^2(i)}{\sum_{i=0}^{N-i} (x_j(i) - y_j(i))^2} \right] \right\}}{L}$$

where L is the number of blocks in the average, N is the size of one block $x_j(i)$ is the is the $i^{th}$ observed input sample in the $j^{th}$ block, and $y_j(i)$ is the $i^{th}$ observed output sample in the $j^{th}$ block.

WSNR-t (Weighted Total Segmental SNR): Similar to SNR-t, except that the perceptually weighted error is used in the measurement.

$$WSNR - t(\text{dB}) = \frac{\sum_{j=0}^{L-1} \left\{ 10 \log_{10} \left[ \frac{\sum_{i=0}^{N-1} x_j^2(i)}{\sum_{i=0}^{N-i} e_{pj}^2(i)} \right] \right\}}{L}$$

A discussion of the filter used to obtain the weighted sequence $e_p^2(i)$ can be found in B. S. Atal, "Predictive Coding of Speech at Low Bit Rates', *IEEEE Transactions on Communications,* vol. COM-30, May 1982. WSNR-t should more accurately reflect the perceived speech quality than SNR-T.

SNR-v (Voiced Speech Segmental SNR): Measured with the same technique as SNR-t, except that only frames with a high energy level are used. SNR-v reflects the reproduction quality of the voiced speech only, while SNR-t counts unvoiced speech and silence periods.

WSNR-v (Voiced Speech Weighted Segmental SNR): As in SNR-v, but using perceptually weighted error sequence.

Using these measures, the data in Table 2 were collected.

TABLE 2

Measured SNR for Baseline and Improved Coders

| Coder | SNR-t | WSNR-t | SNR-v | WSNR-v |
|---|---|---|---|---|
| Baseline | 9.24 | 12.47 | 12.55 | 16.42 |
| Improved | 11.58 | 13.96 | 15.11 | 18.06 |
| Difference | +2.34 | +1.49 | +2.56 | +1.64 |

As shown in Table 2, the improvements described in accordance with this invention increase the SNR from 1.5 to 2.5 dB, depending on the measurement technique.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

Having thus described my invention, what I claim as new and desire to protect by Letters Patent is as follows:

1. A multi-pulse excited linear predictive voice coder comprising:

linear predictive coding analyzer means for receiving an input signal sequence and producing a set of linear predictive filter coefficients in response thereto;

weighted impulse response means connected to receive said set of linear predictive filter coefficients for producing a weighted impulse response h(i);

an error weighting filter means coupled to receive the input sequence, the linear predictive coding (LPC) coefficients and create a weighted input sequence;

cross-correlation means connected to receive said impulse response h(i) and receive the weighted input sequence from the error weighting filter means for generating an output signal corresponding to pulse positions, said cross-correlation means also calculating correlations between the impulse response h(i) and the weighted input sequence;

an optimizer means connected to said cross-correlation means for calculating an optimal simultaneous solution for pulse amplitudes and pitch tap gain;

synthesis means connected to said optimizer means and responsive to said pulse amplitudes and pitch tap gain for creating an excitation sequence and generating an output signal; and an excitation buffer for receiving and storing the excitation sequence.

2. The multi-pulse excited linear predictive voice coder recited in claim 1 further comprising:

pitch detector means for receiving said input signal sequence and for generating a pitch lag output signal in response thereto;

a first pitch synthesis filter means connected to receive said pitch lag output signal so as to generate a pitch predictor sequence; and weighted LPC synthesis filter means connected to receive said linear predictive coefficients and said pitch predictor sequence for generating a filtered pitch predictor sequence in response thereto, said filtered pitch predictor sequence to be supplied to said optimizer means.

3. The multi-pulse linear predictive voice coder recited in claim 2 wherein said synthesis means comprises:

pulse excitation generator means for receiving pulse position and amplitude input data from said optimizer means and for generating a pulse excitation sequence in response thereto;

a second pitch synthesis filter means for receiving a pitch tap gain from said optimizer means, pitch lag from the pitch detector, excitation sequence from excitation buffer, and for generating a final pitch predictor sequence in response thereto; and;

linear predictive code synthesis filter means for receiving a said pulse excitation sequence and said pitch predictor sequence and for generating said output signal in response thereto.

4. The multi-pulse excited linear predictive voice coder recited in claim 1 wherein said optimizer means solves a set of M+1, wherein M represents the number of pulses in a frame, simultaneous equations for a set of coefficients described by the equation:

$$\begin{bmatrix} \sigma_h^2 & R_{hh}(m_1 - m_2) & \cdots & R_{hh}(m_1 = m_M) & R_{hyp}(m_1) \\ R_{hh}(m_1 - m_2) & \sigma_h^2 & \cdots & R_{hh}(m_2 - m_M) & R_{hyp}(m_2) \\ \vdots & \vdots & \cdots & \vdots & \vdots \\ & & & & \end{bmatrix} \begin{bmatrix} g_1 \\ g_2 \\ \vdots \\ \vdots \end{bmatrix} = \begin{bmatrix} R_{hx}(m_1) \\ R_{hx}(m_2) \\ \vdots \\ \vdots \end{bmatrix}.$$

-continued $$\begin{matrix} R_{hh}(m_1 - m_2) & R_{hh}(m_1 - m_2) & \cdots & \sigma_h^2 & R_{hyp}(m_M) & g_M & R_{hx}(m_M) \\ R_{hyp}(m_1) & R_{hyp}(m_2) & \cdots & R_{hyp}(m_M) & \sigma_{yp}^2 & \beta & R_{xyp}(0) \end{matrix}$$

where $g_M$ is the gain for the Mth pulse, $\sigma_h^2$ is the variance of a synthesis filter impulse response, the variance being the sum of the squares of all samples of a sequence being measured, $R_{hh}(m_j - m_k)$ is an auto-correlation of the impulse response at a lag of $|m_j - m_k|$, $R_{hyp}(m_k)$ is a cross-correlation of the impulse response and filtered pitch predictor sequence at position $m_k$, $\sigma_{yp}^2$ is the variance of the filtered pitch predictor sequence, $R_{hx}(mk)$ is a cross-correlation between the impulse response and the weighted input at position $m_k$, and $R_{xyp}(O)$ is a cross-correlation between the filtered pitch predictor sequence and the weighted input.

* * * * *